US010497505B2

(12) United States Patent
Lee et al.

(10) Patent No.: US 10,497,505 B2
(45) Date of Patent: Dec. 3, 2019

(54) MAGNETIC COMPOSITION AND INDUCTOR INCLUDING THE SAME

(71) Applicant: SAMSUNG ELECTRO-MECHANICS CO., LTD., Suwon-si, Gyeonggi-do (KR)

(72) Inventors: Se Hyung Lee, Suwon-si (KR); Je Ik Moon, Suwon-si (KR); Jung Wook Seo, Suwon-si (KR); Jun Sung Lee, Suwon-si (KR); Woo Jin Lee, Suwon-si (KR); Kang Ryong Choi, Suwon-si (KR); Il Jin Park, Suwon-si (KR); Gwang Hwan Hwang, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/471,727

(22) Filed: Mar. 28, 2017

(65) Prior Publication Data

US 2018/0061550 A1 Mar. 1, 2018

(30) Foreign Application Priority Data

Aug. 30, 2016 (KR) ..... 10-2016-0110459
Sep. 20, 2016 (KR) ..... 10-2016-0119972

(51) Int. Cl.
*H01F 5/00* (2006.01)
*H01F 27/255* (2006.01)
(Continued)

(52) U.S. Cl.
CPC ..... *H01F 27/255* (2013.01); *H01F 1/26* (2013.01); *H01F 1/33* (2013.01); *H01F 17/0013* (2013.01);
(Continued)

(58) Field of Classification Search
USPC ..... 336/200, 232, 234, 83
See application file for complete search history.

(56) References Cited

U.S. PATENT DOCUMENTS 10,210,974 B2 2/2019 Ohkubo et al.
2002/0051328 A1* 5/2002 Hasegawa ..... B82Y 10/00 360/322
(Continued)

FOREIGN PATENT DOCUMENTS

CN 105655102 A 6/2016
JP H06-025704 A 2/1994
(Continued)

OTHER PUBLICATIONS

Notice of Office Action issued in Korean Patent Application No. 10-2016-0119972, dated Feb. 27, 2017 (English Translation).
(Continued)

*Primary Examiner* — Elvin G Enad
*Assistant Examiner* — Kazi Hossain
(74) *Attorney, Agent, or Firm* — Morgan, Lewis & Bockius LLP

(57) ABSTRACT

A magnetic composition includes first, second, and third magnetic metal particles. The first magnetic metal particles have an average particle size of 10 μm to 28 μm; the second magnetic metal particles have an average particle size of 1 μm to 4.5 μm; and the third magnetic metal particles include insulating layers disposed on surfaces thereof and have a particle size of 300 nm or less. Therefore, eddy current loss of an inductor having a body formed of the magnetic composition may be improved, and high efficiency and inductance of the inductor may be secured.

8 Claims, 4 Drawing Sheets

(51) Int. Cl.

| | |
|---|---|
| ***H01F 27/28*** | (2006.01) |
| ***H01F 27/29*** | (2006.01) |
| ***H01F 1/26*** | (2006.01) |
| ***H01F 1/33*** | (2006.01) |
| ***H01F 17/00*** | (2006.01) |
| ***H01F 17/04*** | (2006.01) |

(52) U.S. Cl.
CPC ..... *H01F 17/04* (2013.01); *H01F 27/2804* (2013.01); *H01F 27/29* (2013.01); *H01F 27/292* (2013.01); *H01F 2017/048* (2013.01)

(56) References Cited

U.S. PATENT DOCUMENTS

| | | | | |
|---|---|---|---|---|
| 2005/0105225 | A1* | 5/2005 | Ahn | H01F 17/0033 361/18 |
| 2007/0235109 | A1* | 10/2007 | Maeda | B22F 1/02 148/307 |
| 2008/0029300 | A1* | 2/2008 | Harada | B22F 1/02 174/391 |
| 2010/0323206 | A1 | 12/2010 | Soma et al. | |
| 2013/0120097 | A1* | 5/2013 | Hachiya | H01F 1/40 336/200 |
| 2014/0077914 | A1* | 3/2014 | Ohkubo | H01F 5/00 336/177 |
| 2014/0104023 | A1* | 4/2014 | Yang | B22F 1/02 335/297 |
| 2015/0022308 | A1 | 1/2015 | Moon et al. | |
| 2015/0028983 | A1 | 1/2015 | Ryu et al. | |
| 2015/0083960 | A1 | 3/2015 | Tanada et al. | |
| 2015/0102888 | A1 | 4/2015 | Kim et al. | |
| 2016/0042859 | A1 | 2/2016 | Park et al. | |
| 2016/0155550 | A1 | 6/2016 | Ohkubo et al. | |
| 2016/0180995 | A1 | 6/2016 | Park et al. | |
| 2017/0236633 | A1* | 8/2017 | Park | H01F 27/22 336/55 |

FOREIGN PATENT DOCUMENTS

| | | | |
|---|---|---|---|
| JP | 2008-041961 | A | 2/2008 |
| JP | 2009-054709 | A | 3/2009 |
| JP | 2009-206483 | A | 9/2009 |
| JP | 2009-283774 | A | 12/2009 |
| JP | 2011-032496 | A | 2/2011 |
| JP | 2013-546162 | A | 12/2013 |
| JP | 2015-061052 | A | 3/2015 |
| JP | 2016-103598 | A | 6/2016 |
| KR | 2015-0011168 | A | 1/2015 |
| KR | 10-2015-0043038 | A | 4/2015 |
| KR | 10-2015-0059731 | A | 6/2015 |
| KR | 10-1588966 | | 1/2016 |
| KR | 10-2016-0065007 | A | 6/2016 |
| KR | 2016-0076840 | A | 7/2016 |

OTHER PUBLICATIONS

Office Action issued in Korean Patent Application No. 10-2016-0119972, dated Jul. 28, 2017 (With English Translation).
Japanese Office Action issued in corresponding Japanese Patent Application No. 2017-060429, dated Mar. 27, 2018, with English Translation.
Notice of Office Action issued in Korean Patent Application No. 10-2016-0119972, dated Aug. 30, 2018 (English translation).
Notice of Office Action issued in Japanese Patent Application No. 2017-060429, dated Sep. 18, 2018 (English translation).
Office Action issued in Chinese Patent Application No. 201710341862.4 dated Apr. 17, 2019, with English translation.

* cited by examiner

MAGNETIC COMPOSITION AND INDUCTOR INCLUDING THE SAME

CROSS-REFERENCE TO RELATED APPLICATION(S)

This application claims benefit of priority to Korean Patent Applications No. 10-2016-0110459 filed on Aug. 30, 2016 and No. 10-2016-0119972 filed on Sep. 20, 2016 in the Korean Intellectual Property Office, the disclosures of which are incorporated herein by reference in their entireties.

BACKGROUND

1. Field

The present disclosure relates to a magnetic composition and an inductor including the same.

2. Description of Related Art

To address industrial demand, efforts have been made to increase power converter efficiency. Factors having a detrimental influence on power converter efficiency can be mainly divided into losses from switches and losses from passive elements. Losses from switches may be divided into losses from insulated gate bipolar transistor(s) (IGBT) and losses from diode(s), and losses from passive elements may be divided into losses from inductor(s) and losses from capacitor(s).

Here, losses from inductor(s) includes copper losses, load-dependent losses having a magnitude increased as a magnitude of a load having an influence on the inductor is increased, iron losses, load-independent losses having a constant magnitude regardless of a load, and the like. Copper loss is generated in a winding resistor of the inductor, while iron loss is generated when the inductor is driven in a continuous conduction mode at a predetermined switching frequency.

The load-dependent loss has an influence on efficiency in an entire load region, and is significantly affected by conduction loss in particular, such that a ratio of load-dependent loss in a heavy load may be significantly high. On the other hand, load-independent loss has a small change width depending on a load, such that a ratio occupied by the load-independent loss in the heavy load may be small, but a larger ratio is occupied by the load-independent loss than by the load-dependent loss in a light load. Therefore, it may be effective to reduce the load-independent loss in order to improve light load efficiency.

Iron loss is significantly varied by magnetic flux density, and can be divided into hysteresis loss and eddy current loss. Hysteresis loss is affected by impurities in the inductor, an electric potential of the inductor, a grain boundary of the inductor, and a factor of interfaces between powder particles of the inductor, while eddy current loss, generated in powder particles included in a body, may be increased depending on sizes of the particles and an insulation level of the particles.

A method of reducing the sizes of the particles in order to reduce eddy current loss exists. However, when the sizes of particles are reduced, magnetic permeability is reduced, such that inductance is reduced.

Therefore, a method capable of reducing eddy current loss is needed.

SUMMARY

An aspect of the present disclosure may provide a magnetic composition capable of securing high efficiency and inductance by reducing eddy current loss when used to form a body of an inductor. The disclosure further details an inductor including the magnetic composition.

According to an aspect of the present disclosure, a magnetic composition includes first, second, and third magnetic metal particles. The first magnetic metal particles have an average particle size of 10 μm to 28 μm; the second magnetic metal particles have an average particle size of 1 μm to 4.5 μm; and the third magnetic metal particles include insulating layers disposed on surfaces thereof and have a particle size of 300 nm or less.

According to another aspect of the disclosure, an inductor includes a body including magnetic metal particles; and a coil part disposed in the body. The magnetic metal particles disposed in the body include first magnetic metal particles having an average particle size of 10 μm to 28 μm, second magnetic metal particles having an average particle size of 1 μm to 4.5 μm, and third magnetic metal particles including insulating layers disposed on surfaces thereof and having a particle size of 300 nm or less.

According to a further aspect of the disclosure, a magnetic body includes a resin; first magnetic metal particles having an average particle size of 10 μm to 28 μm and dispersed in the resin; second magnetic metal particles having an average particle size of 1 μm to 4.5 μm and dispersed in the resin in spaces between the first magnetic metal particles having the average particle size of 10 μm to 28 μm; and third magnetic metal particles including insulating layers disposed on surfaces thereof, having the particle size of 300 nm or less, and dispersed in the resin in spaces between the first magnetic metal particles having the average particle size of 10 μm to 28 μm and between the second magnetic metal particles having the average particle size of 1 μm to 4.5 μm.

According to a further aspect of the disclosure, a magnetic composition includes magnetic metal particles dispersed in a resin. The magnetic metal particles include first magnetic metal particles including insulating layers disposed on surfaces thereof and having a particle size of 300 nm or less, wherein the first magnetic metal particles represent 1 wt % to 20 wt % with respect to 100 wt % of the magnetic metal particles in the magnetic composition. The magnetic metal particles further include second magnetic metal particles having an average particle size of 1 μm to 28 μm and representing a remainder of the 100 wt % of the magnetic metal particles in the magnetic composition.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
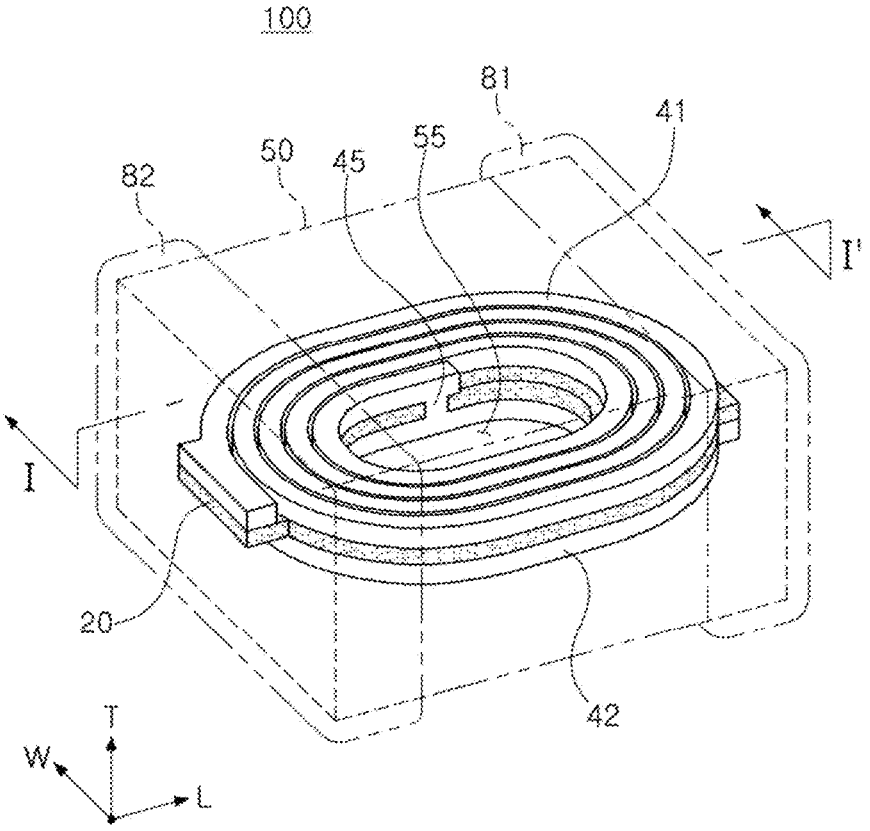
FIG. 1 is a schematic perspective view illustrating an inductor according to an exemplary embodiment.

Hereinafter, exemplary embodiments of the present disclosure will be described in detail with reference to the accompanying drawings.

Hereinafter, a magnetic composition according to the present disclosure will be described.

A magnetic composition according to an exemplary embodiment may include magnetic metal particles, wherein the magnetic metal particles may include first magnetic metal particles having an average particle size of 10 μm to 28 μm, second magnetic metal particles having an average particle size of 1 μm to 4.5 μm, and third magnetic metal particles including insulating layers formed on surfaces thereof and having a particle size of 300 nm or less.

The magnetic composition may include the magnetic metal particles and a resin, and may have a form in which the magnetic metal particles are dispersed in the resin.

The magnetic metal particles may include one or more selected from the group consisting of iron (Fe), silicon (Si), chromium (Cr), aluminum (Al), cobalt (Co), and nickel (Ni), and may be, for example, Fe—Si—Cr based alloys.

The resin may be a thermosetting resin such as an epoxy resin, a polyimide resin, or the like.

The magnetic metal particles may include the first, second, and third magnetic metal particles having different sizes. In detail, the first magnetic metal particles may have the average particle size of 10 μm to 28 μm, the second magnetic metal particles may have the average particle size of 1 μm to 4.5 μm, and the third magnetic metal particles may have the particle size of 300 nm or less. That is, the first magnetic metal particles may be coarse powder particles, the second magnetic metal particles may be fine powder particles, and the third magnetic metal particles may be ultrafine powder particles.

The first magnetic metal particles may have the average particle size of 10 μm to 28 μm in order to reduce hysteresis loss of the magnetic composition in a low frequency band and significantly reduce eddy current loss of the magnetic composition in a high frequency band.

The second magnetic metal particles may have the average particle size of 1 μm to 4.5 μm in order to increase a saturation current (Isat) of the magnetic composition, and the third magnetic metal particles may have the particle size of 300 nm or less in order to reduce a packing factor of powder particles in a body and the eddy current loss.

In general, when sizes of magnetic metal particles are reduced, eddy current loss may be reduced, but magnetic permeability of a body of an inductor is reduced, such that it is difficult to implement inductance, a main factor in the inductor.

The magnetic composition according to the exemplary embodiment may include the third magnetic metal particles having the insulating layers formed on the surfaces thereof and having the particle size of 300 nm or less. Therefore, the magnetic composition includes the third magnetic metal particles having a small particle size, such that the eddy current loss may be reduced, and inductance of the inductor may be secured by the insulating layers formed on the surfaces of the third magnetic metal particles.

The insulating layer may be an oxide film, may include one or more layers, and may include at most three layers.

The insulating layer may be formed of FeO in a case in which it includes one layer, may have one structure of FeO/SiO and FeO/CrO in a case in which it includes two layers, and may have a structure of FeO/CrO/SiO in a case in which it includes three layers.

The insulating layer may have one layer formed of FeO, and may have excellent magnetic characteristics due to characteristics of a thin insulating layer.

In the case in which the insulating layer includes the two layers, the insulating layer may be formed on a surface of a core and may include a first layer formed of FeO and a second layer formed on the first layer and formed of one of SiO and CrO. A thickness of the second layer may be equal to or smaller than that of the first layer. SiO may have excellent insulation properties, and CrO may serve to prevent rapid oxidation of a surface of the core generated while being exposed in the air.

In the case in which the insulating layer includes the three layers, the insulating layer may be formed on a core, and may include a first layer formed on a surface of the core and formed of FeO, a second layer formed on the first layer and formed of CrO, and a third layer formed on the second layer and formed of SiO. Thicknesses of the respective layers may be the same as or different from each other.

The insulating layer including the three layers may include an FeO layer, an SiO layer, and a CrO layer, may prevent oxidation of the surface of the core, may have excellent insulation properties, and may reduce eddy current loss to improve efficiency of the inductor.

A thickness of the insulating layer may be 1% to 20% of the particle size of the third magnetic metal particle.

When the thickness of the insulating layer exceeds 20% of the particle size of the third magnetic metal particle, magnetic permeability and magnetic susceptibility of the inductor may be reduced. Therefore, it may be preferable that the thickness of the insulating layer is as thin as possible.

A content of the first magnetic metal particles may be 70 wt % to 79 wt %, a content of the second magnetic metal particles may be 10 wt % to 20 wt %, and a content of the third magnetic metal particles may be 1 wt % to 20 wt %, with respect to 100 wt % of the magnetic metal particles in the composition.

In order to increase the magnetic permeability of the inductor, the content of the first magnetic metal particles may be 70 wt % to 79 wt % with respect to 100 wt % of the magnetic metal particles, and the content of the second magnetic metal particles may be 10 wt % to 20 wt % with respect to 100 wt % of the magnetic metal particles.

In order to reduce the eddy current loss and improve inductance of the inductor, the content of the third magnetic metal particles may be 1 wt % to 20 wt % with respect to 100 wt % of the magnetic metal particles.

When the content of the third magnetic metal particles is less than 1 wt %, an inductance improving effect may be less, and when the content of the third magnetic metal particles exceeds 20 wt %, inductance of the inductor may be increased due to an increase in a packing factor in the body of the inductor, but a quality (Q) factor may be reduced. Therefore, it can be preferable that the content of the third magnetic metal particles is 1 wt % to 20 wt %.

Since the magnetic composition according to the exemplary embodiment includes the third magnetic metal particles having the particle size of 300 nm or less and including the insulating layers formed on the surfaces thereof, the packing factor of the powder particles in the body of the inductor may be increased and the eddy current loss may be reduced, such that the inductance of the inductor may be improved and the inductor may have high efficiency.

An inductor according to the present disclosure will hereinafter be described with reference to the accompanying drawings.

Figure 2:
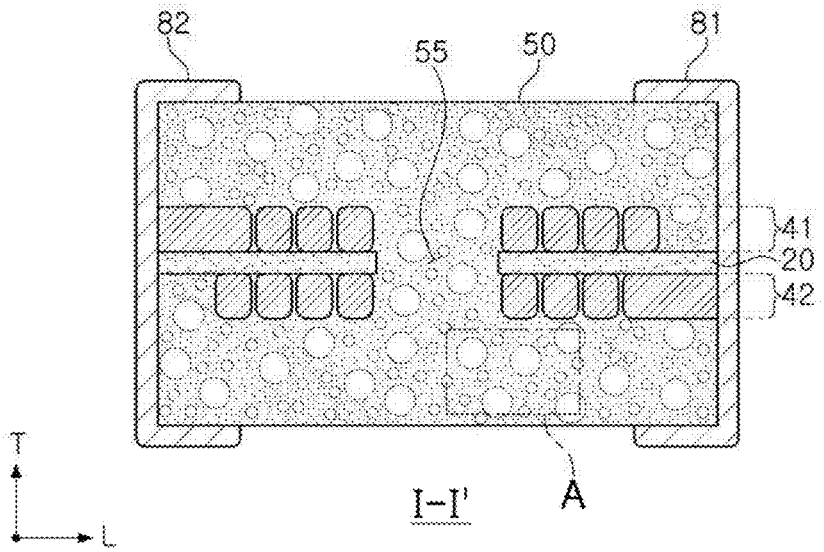
FIG. 2 is a schematic cross-sectional view of the inductor according to the exemplary embodiment taken along line I-I' of FIG. 1.

FIG. 1 is a schematic perspective view illustrating an inductor according to an exemplary embodiment, and FIG. 2 is a schematic cross-sectional view of the inductor according to the exemplary embodiment taken along line I-I' of FIG. 1.

Referring to FIGS. 1 and 2, an inductor 100 according to an exemplary embodiment may include a body 50 including magnetic metal particles 61, 63, and 65 (shown in FIG. 3) and coil parts 20, 41, and 42 disposed in the body 50. The magnetic metal particles may include first magnetic metal particles 61 (shown in FIG. 3) having an average particle size of 10 μm to 28 μm, second magnetic metal particles 63 (shown in FIG. 3) having an average particle size of 1 μm to 4.5 μm, and third magnetic metal particles 65 (shown in FIG. 3) including insulating layers 65*b* formed on surfaces thereof and having a particle size of 300 nm or less.

The body 50 may form an external appearance of the inductor. The body 50 may have one surface, the other surface opposing the one surface, and surfaces connecting the one surface and the other surface to each other. L, W, and T directions illustrated in FIG. 1 refer to a length direction, a width direction, and a thickness direction, respectively. The body 50 may have a hexahedral shape including upper and lower surfaces opposing each other in a stacking direction (a thickness direction) of coil layers, end surfaces opposing each other in a length direction, and side surfaces opposing each other in a width direction, and the lower surface (the other surface) of the body may be a mounting surface used at the time of mounting the inductor on a printed circuit board to contact the printed circuit board. Corners at which the respective surfaces meet each other may be rounded by grinding, or the like, in some examples.

The body 50 may include a magnetic material having a magnetic property.

The body 50 may be formed by forming coil parts and then stacking, compressing, and hardening sheets including a magnetic material on and beneath the coil parts. The magnetic material may be a resin including magnetic metal particles such as those described in this disclosure.

Figure 3:
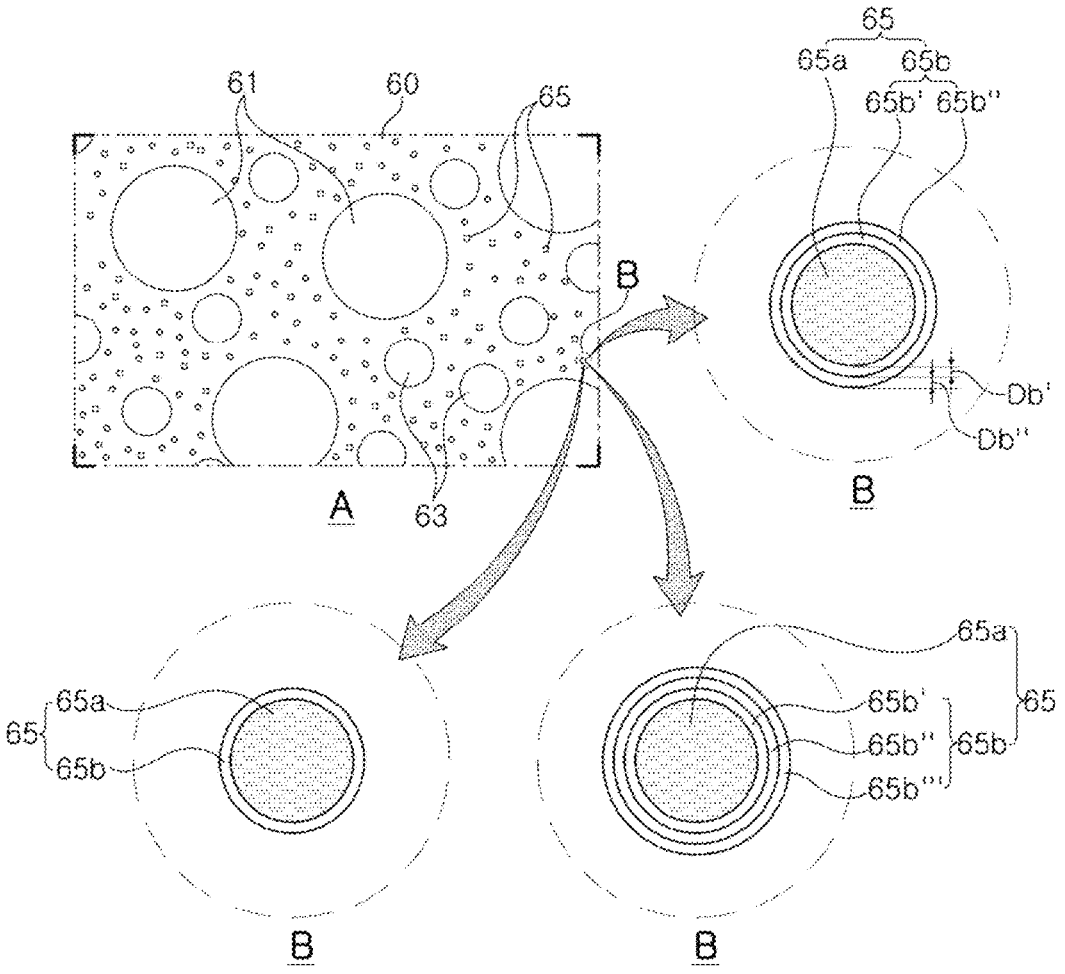
FIG. 3 is a schematic enlarged view of part A of FIG. 2.

The body 50 may have a form in which the magnetic metal particles 61, 63, and 65 are dispersed in a resin 60, as shown in FIG. 3.

The magnetic metal particles 61, 63, and 65 may include one or more selected from the group consisting of iron (Fe), silicon (Si), chromium (Cr), aluminum (Al), and nickel (Ni), and may be Fe—Si—Cr based alloys.

The resin 60 may be a thermosetting resin such as an epoxy resin, a polyimide resin, or the like.

Eddy current loss of the inductor is increased depending on sizes of particles and an insulation level of the particles, and is increased as a frequency is increased. As a method of reducing eddy current loss, a method of reducing sizes of the magnetic metal particles included in the body is provided. However, when the sizes of the magnetic metal particles are reduced, magnetic permeability of the body is reduced, such that an inductance value of the inductor is reduced.

FIG. 3 is a schematic enlarged view of part A of FIG. 2.

Referring to FIG. 3, the body 50 of the inductor according to the exemplary embodiment includes the third magnetic metal particles 65 including the insulating layers 65*b* formed on the surfaces thereof and having the particle size of 300 nm or less, such that the eddy current loss of the inductor may be reduced, and a packing factor of the magnetic metal particles in the body may be increased. Therefore, inductance of the inductor may be secured.

The insulating layer 65*b* may be an oxide film, may include one or more layers, and may include at most three layers. For example, the insulating layer 65*b* may include at most three layers each formed of a different material.

The insulating layer 65*b* may be formed of FeO in a case in which it includes one layer, may have one structure of FeO/SiO and FeO/CrO in a case in which it includes two layers, and may have a structure of FeO/CrO/SiO in a case in which it includes three layers.

The insulating layer may have one layer formed of FeO, and may have excellent magnetic characteristics due to characteristics of a thin insulating layer.

In the case in which the insulating layer 65*b* includes the two layers, the insulating layer 65*b* may be formed on a surface of a core 65*a*, and may include a first layer 65*b*' formed of FeO and a second layer 65*b*" formed on the first layer 65*b*' and formed of one of SiO and CrO. A thickness Db" of the second layer may be equal to or smaller than a thickness Db' of the first layer. SiO may have excellent insulation properties, and CrO may serve to prevent rapid oxidation of a surface of the core generated while being exposed in the air.

In the case in which the insulating layer 65*b* includes the three layers, the insulating layer 65*b* may be formed on a core, and may include a first layer 65*b*' formed on a surface of the core and formed of FeO, a second layer 65*b*" formed on the first layer 65*b*' and formed of CrO, and a third layer 65*b*'" formed on the second layer 65*b*" and formed of SiO. Thicknesses of the respective layers may be the same as or different from each other.

The insulating layer including the three layers may include an FeO layer, an SiO layer, and a CrO layer, may prevent oxidation of the surface of the core, may have excellent insulation properties, and may reduce eddy current loss to improve efficiency of the inductor.

A thickness of the insulating layer may be 1% to 20% of the particle size of the third magnetic metal particle.

When the thickness of the insulating layer exceeds 20% of the particle size of the third magnetic metal particle, magnetic permeability and magnetic susceptibility of the inductor may be reduced. Therefore, it may be preferable that the thickness of the insulating layer is as thin as possible.

In order to increase the magnetic permeability of the inductor, a content of the first magnetic metal particles 61 may be 70 wt % to 79 wt % with respect to 100 wt % of the magnetic metal particles in the magnetic composition, and a content of the second magnetic metal particles 63 may be 10 wt % to 20 wt % with respect to 100 wt % of the magnetic metal particles in the magnetic composition.

In order to reduce the eddy current loss and improve inductance of the inductor, a content of the third magnetic metal particles 65 may be 1 wt % to 20 wt % with respect to 100 wt % of the magnetic metal particles.

When the content of the third magnetic metal particles is less than 1 wt %, an inductance improving effect may be less, and when the content of the third magnetic metal particles exceeds 20 wt %, inductance of the inductor may be increased due to an increase in a packing factor in the body of the inductor, but a quality (Q) factor may be reduced. Therefore, it may be preferable that the content of the third magnetic metal particles is 1 wt % to 20 wt %.

Table 1 represents inductances of inductors depending on contents of the third magnetic metal particles. Sizes and materials of the respective samples are the same as each other, and only contents of the third magnetic metal particles of the respective samples are different from each other.

TABLE 1

| Division | Content (wt %) of Third Magnetic Metal Particles | Change Rate (%) in Inductance as compared to Standard (ref: 100%) |
|---|---|---|
| 1* | 0 | 100 |
| 2 | 5 | 120~124 |
| 3 | 10 | 143~148 |
| 4 | 15 | 160~165 |
| 5 | 20 | 175~185 |
| 6* | 25 | 170~179 |
| 7* | 30 | 158~172 |
| 8* | 35 | 148~165 |

*Comparative Example

It may be appreciated from Table 1 that inductance of an inductor is increased as a content of the third magnetic metal particles is increased up to 20 wt %. The increase maybe due to an increase in magnetic permeability of a body of the inductor caused by an increase in a packing factor of powder particles in the body of the inductor.

It may also be appreciated that inductance of the inductor is reduced as a content of the third magnetic metal particles exceeds 20 wt %.

Figure 4:
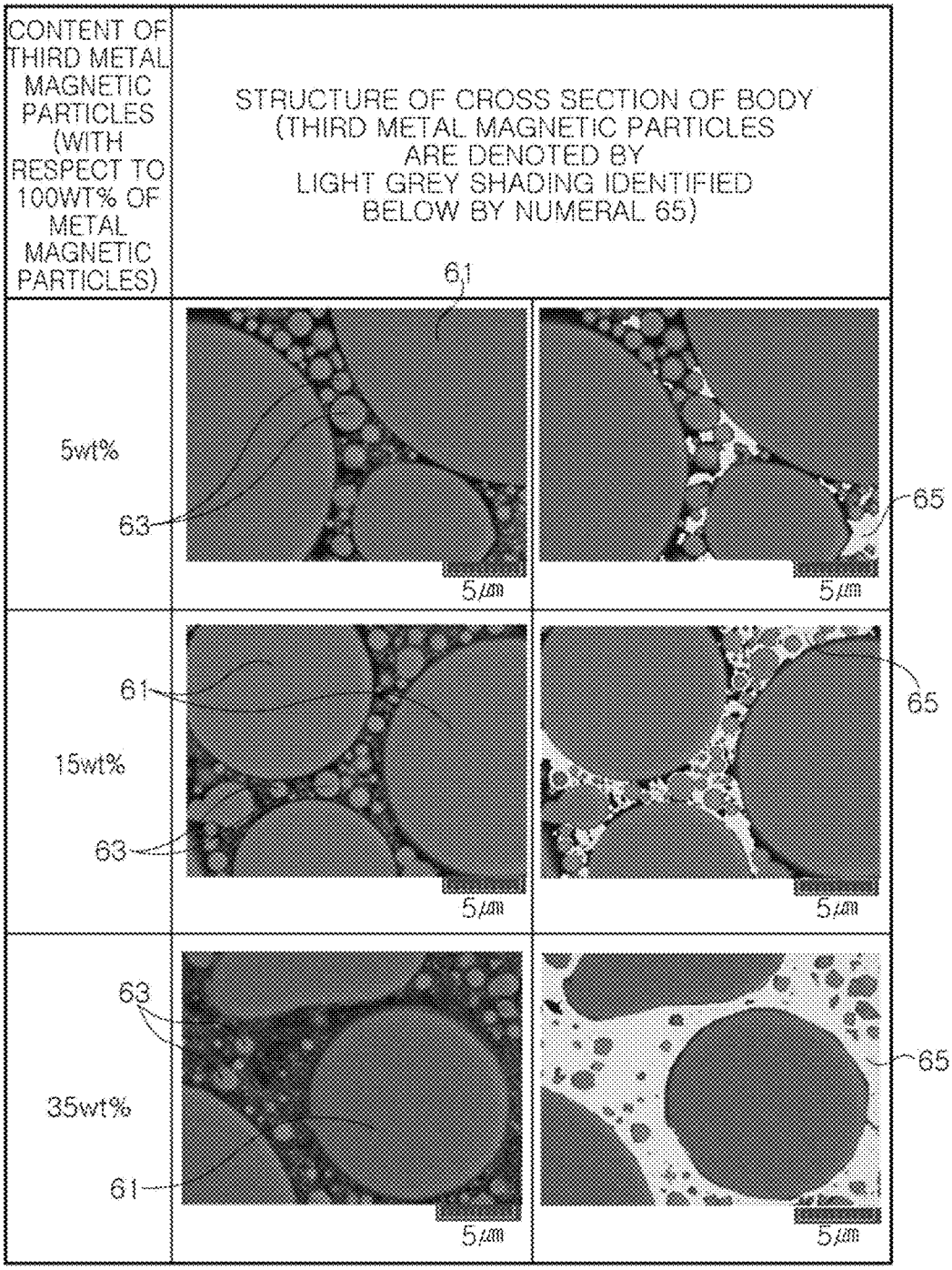
FIG. 4 shows scanning electron microscope (SEM) photographs illustrating structures of cross sections of bodies of inductors depending on contents of third magnetic metal particles.

FIG. 4 shows scanning electron microscope (SEM) photographs illustrating structures of cross sections of bodies of inductors depending on contents of third magnetic metal particles.

The body refers to a body including first magnetic metal particles having an average particle size of 10 μm to 28 μm, second magnetic metal particles having an average particle size of 1 μm to 4.5 μm, and third magnetic metal particles including insulating layers formed on surfaces thereof and having a particle size of 300 nm or less.

It may be appreciated from FIG. 4 that the third magnetic metal particles, which are ultrafine powder particles, are included between the first and second magnetic metal particles, and a packing factor of powder particles in the body is increased as a content of the third magnetic metal particles is increased.

Figure 5:
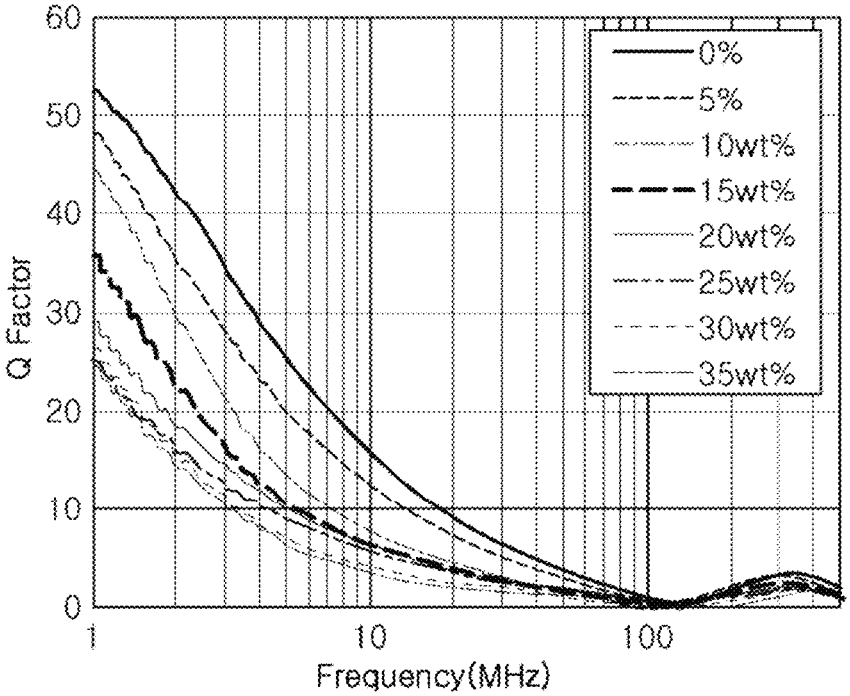
FIG. 5 is a plot illustrating changes in quality (Q) factors of inductors depending on frequencies and depending on contents of third magnetic metal particles.

FIG. 5 is a plot illustrating changes in quality (Q) factors depending on frequencies of inductors depending on contents of third magnetic metal particles (in wt %).

Referring to FIG. 5, as a content of the third magnetic metal powder particles is increased, a packing factor of powder particles in a body is increased, such that parasitic capacitance having an influence on a resonant frequency is reduced and a Q factor is reduced. Meanwhile, it may be appreciated that a Q factor is significantly reduced as a content of the third magnetic metal particles exceeds 20 wt %.

The coil parts may perform various functions in an electronic apparatus through a property implemented by a coil of the inductor 100. For example, the inductor 100 may be a power inductor. In this case, the coil parts may serve to store electricity in magnetic field form to maintain an output voltage, thereby stabilizing power.

The coil parts may include first and second coil patterns 41 and 42 formed, respectively, on upper and lower opposing surfaces of a support member 20. The first and second coil patterns 41 and 42 may be coil layers disposed to face each other in relation to the support member 20.

The first and second coil patterns 41 and 42 may be formed using a photolithography method or a plating method.

A material or a type of support member 20 is not particularly limited as long as the support member 20 may support the first and second coil patterns 41 and 42. For example, the support member 20 may be a copper clad laminate (CCL), a polypropylene glycol (PPG) substrate, a ferrite substrate, a metal based soft magnetic substrate, or the like. Alternatively, the support member 20 may be an insulating substrate formed of an insulating resin. The insulating resin may be a thermosetting resin such as an epoxy resin, a thermoplastic resin such as a polyimide resin, a resin having a reinforcement material such as a glass fiber or an inorganic filler impregnated in the thermosetting resin and the thermoplastic resin, such as prepreg, Ajinomoto Build-up Film (ABF), FR-4, a Bismaleimide Triazine (BT) resin, a photoimagable dielectric (PID) resin, or the like. An insulating substrate containing a glass fiber and an epoxy resin may be used as the support member in order to maintain rigidity. However, the support member is not limited thereto.

The support member 20 may have a hole formed in central portions of the upper and lower surfaces thereof to penetrate therethrough, and the hole may be filled with a magnetic material such as ferrite, magnetic metal particles, or the like, to form a core part 55. The core part filled with the magnetic material may be formed to increase inductance L. The core part may be filled with the same material used to form the body 50.

The first and second coil patterns 41 and 42 stacked on both surfaces of the support member, respectively, may be electrically connected to each other through a via 45 penetrating through the support member 20.

The via 45 may be formed by forming a through-hole through the support member 20 using mechanical drilling, laser drilling, or the like, and then filling a conductive material in the through-hole by plating.

A shape or a material of the via 45 is not particularly limited as long as the via 45 may electrically connect the first and second coil patterns (upper and lower coil patterns) 41 and 42 disposed, respectively, on both surfaces of the support member 20 to each other. Here, the terms "upper" and "lower" are used in relation to a stacking direction of the coil patterns as shown in the drawings.

The via 45 may include a conductive material such as copper (Cu), aluminum (Al), silver (Ag), tin (Sn), gold (Au), nickel (Ni), lead (Pd), or alloys thereof.

A cross section of the via 45 may have a trapezoidal or hourglass shape.

A cross section of the via 45 may have a hourglass shape. This shape may be implemented by processing the upper surface or the lower surface of the support member. Therefore, a width of the cross section of the via may be reduced. A width of the cross section of the via may range from 60 to 80 μm, but is not limited thereto.

The first and second coil patterns 41 and 42 may be coated with insulating layers (not illustrated), and may not directly contact the magnetic material forming the body 50 and core part 55.

The insulating layers may serve to protect the first and second coil patterns.

Any material including an insulating material may be used as materials of the insulating layers. For example, an insulating material used for general insulation coating, such as an epoxy resin, a polyimide resin, a liquid crystalline polymer resin, or the like, may be used as materials of the insulating layers or the known photoimagable dielectric (PID) resin, or the like, may be used as materials of the insulating layers. However, the materials of the insulating layers are not limited thereto.

Referring to FIGS. 1 and 2, the inductor 100 according to the exemplary embodiment may include first and second external electrodes 81 and 82 electrically connected to the first and second coil patterns 41 and 42, respectively, and formed on both end surfaces of the body 50, respectively.

The first and second external electrodes 81 and 82 may be electrically connected to lead terminals of the first and second coil patterns 41 and 42 exposed to respective end surfaces of the body 50.

The first and second external electrodes 81 and 82 may serve to electrically connect the coil parts in the inductor to the electronic apparatus when the inductor is mounted in the electronic apparatus.

The first and second external electrodes 81 and 82 may be formed of a conductive paste including a conductive metal. Here, the conductive metal may be copper (Cu), nickel (Ni), tin (Sn), silver (Ag), or the like, or alloys thereof.

The first and second external electrodes may include plating layers formed on the conductive paste.

The plating layer may include one or more selected from the group consisting of nickel (Ni), copper (Cu), and tin (Sn). For example, a nickel (Ni) layer and a tin (Sn) layer may be sequentially formed in the plating layer.

As set forth above, according to the exemplary embodiment, eddy current loss of the inductor may be improved, and high efficiency and inductance of the inductor may be secured.

While exemplary embodiments have been shown and described above, it will be apparent to those skilled in the art that modifications and variations could be made without departing from the scope of the present invention as defined by the appended claims.

What is claimed is:

1. A magnetic body comprising:

a resin;

first magnetic metal particles having an average particle size of 10 μm to 28 μm and dispersed in the resin;

second magnetic metal particles having an average particle size of 1 μm to 4.5 μm and dispersed in the resin in spaces between the first magnetic metal particles having the average particle size of 10 μm to 28 μm; and third magnetic metal particles including insulating layers disposed on surfaces thereof, having the particle size of 300 nm or less, and dispersed in the resin in spaces between the first magnetic metal particles having the average particle size of 10 μm to 28 μm and between the second magnetic metal particles having the average particle size of 1 μm to 4.5 μm, wherein the insulating layer disposed on surfaces of the third magnetic metal particles having the particle size of 300 nm or less includes at least a first insulating layer disposed on surfaces of the third magnetic metal particles and formed of FeO and a second insulating layer disposed on the first insulating layer and formed of CrO and a third insulating layer formed of SiO and disposed on the second insulating layer formed of CrO.

2. The magnetic body of claim 1, further comprising:

a coil part disposed in the body, wherein the resin and first, second, and third magnetic metal particles surround the coil part and extend in a central hole of the coil part to form a core part.

3. The magnetic body of claim 1, wherein a content of the first magnetic metal particles is 70 wt % to 79 wt %, a content of the second magnetic metal particles is 10 wt % to 20 wt %, and a content of the third magnetic metal particles is 1 wt % to 20 wt %, with respect to 100 wt % of the first, second, and third magnetic metal particles dispersed in the resin.

4. The magnetic body of claim 1, wherein the first insulating layer formed of FeO is disposed directly on surfaces of the third magnetic metal particles having the particle size of 300 nm or less, and the second insulating layer formed of CrO is disposed directly on surfaces of the first insulating layer formed of FeO.

5. The magnetic body of claim 1, wherein the insulating layer disposed on surfaces of the third magnetic metal particles having the particle size of 300 nm or less and having the first, second, and third insulating layers has a thickness of 1% to 20% of the particle size of the third magnetic metal particle.

6. A magnetic composition comprising:

magnetic metal particles dispersed in a resin, wherein the magnetic metal particles include:

first magnetic metal particles including insulating layers disposed on surfaces thereof and having a particle size of 300 nm or less, wherein the first magnetic metal particles represent 1 wt % to 20 wt % with respect to 100 wt % of the magnetic metal particles in the magnetic composition; and second magnetic metal particles having an average particle size of 1 μm to 28 μm and representing a remainder of the 100 wt % of the magnetic metal particles in the magnetic composition, and wherein the insulating layer disposed on surfaces of the first magnetic metal particles having the particle size of 300 nm or less includes at least a first insulating layer disposed on surfaces of the first magnetic metal particles and formed of FeO and a second insulating layer disposed on the first insulating layer and formed of CrO and a third insulating layer formed of SiO and disposed on the second insulating layer formed of CrO.

7. The magnetic composition of claim 6, wherein the second magnetic metal particles include:

magnetic metal particles having an average particle size of 10 μm to 28 μm, and representing 70 wt % to 79 wt % of the magnetic metal particles in the magnetic composition; and magnetic metal particles having an average particle size of 1 μm to 4.5 μm, and representing 10 wt % to 20 wt % of the magnetic metal particles in the magnetic composition.

8. The magnetic composition of claim 6, wherein a thickness of the insulating layer disposed on surfaces of the first magnetic metal particles having the particle size of 300 nm or less is 1% to 20% of the particle size of the first magnetic metal particles.

* * * * *